US007228920B2

(12) United States Patent
Harthauser

(10) Patent No.: US 7,228,920 B2
(45) Date of Patent: Jun. 12, 2007

(54) DRILLING APPARATUS AND METHOD FOR INTRODUCING A DRILLING ELEMENT INTO THE SOIL

(75) Inventor: Werner Harthauser, Wertingen (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 274 days.

(21) Appl. No.: 10/943,934

(22) Filed: Sep. 20, 2004

(65) Prior Publication Data

US 2005/0061550 A1 Mar. 24, 2005

(30) Foreign Application Priority Data

Sep. 24, 2003 (DE) ..... 103 44 352

(51) Int. Cl.
*E21B 7/00* (2006.01)
*E21B 3/02* (2006.01)

(52) U.S. Cl. ..... 175/113; 175/195; 175/57

(58) Field of Classification Search ..... 175/57, 175/113, 114, 170, 171, 195, 85, 121
See application file for complete search history.

(56) References Cited

U.S. PATENT DOCUMENTS

| | | | | |
|---|---|---|---|---|
| 3,892,140 A | | 7/1975 | Fox et al. | |
| 4,719,978 A | | 1/1988 | Klemm | |
| 5,062,490 A | * | 11/1991 | Rassieur | 173/104 |
| 5,549,170 A | * | 8/1996 | Barrow | 175/55 |

FOREIGN PATENT DOCUMENTS

| | | |
|---|---|---|
| DE | 2 421 714 | 12/1974 |
| DE | 35 44 086 A1 | 6/1987 |
| DE | 195 29 554 A1 | 2/1997 |

* cited by examiner

*Primary Examiner*—Jennifer H Gay
*Assistant Examiner*—Brad Harcourt
(74) *Attorney, Agent, or Firm*—Jacobson Holman PLLC

(57) ABSTRACT

The invention relates to a drilling apparatus and a method for introducing a drilling element into the soil. The drilling element is rotatably and slidably supported on a mast, with a torque being applied through a rotary drive located on the mast. In order to support the torque an additional turning device is fixed to the mast, which can be engaged with the driven drilling element.

14 Claims, 3 Drawing Sheets

DRILLING APPARATUS AND METHOD FOR INTRODUCING A DRILLING ELEMENT INTO THE SOIL

BACKGROUND OF THE INVENTION

1. Field of the Invention

The invention relates to a drilling apparatus for introducing a drilling element into the soil comprising a rotary drive, which is supported on a mast for introducing the drilling element arranged rotatably and slidably on the mast, and a turning device having a collet that can be turned by means of at least one operating cylinder.

The invention further relates to a method for introducing a drilling element into the soil, wherein the drilling element is set into rotation by means of a rotary drive and slid along a mast.

2. Description of Related Art

In the prior art a variety of soil drilling machines is known which are especially employed in specialist foundation engineering for foundation measures. With these drilling machines a drill hole can either be produced by means of a drilling tool, with the hole being then filled with concrete for example in order to produce a foundation pile. Furthermore, with a drilling apparatus a screw anchor or a bored pile with a screw tip can also be screwed directly into the soil. Especially in the latter case relatively high torques may be required for great pile lengths in order to screw the pile into the soil.

The drive of the drilling apparatus is to be designed according to the maximum torque to be expected, for which reason the drive constitutes a major cost factor in a drilling apparatus.

To produce cased drillings, drilling apparatuses are known which are additionally provided with a casing machine that serves to screw in the supporting casings. Such casing machines have a collet which can be turned through operating cylinders.

SUMMARY OF THE INVENTION

The invention is based on the object to provide a drilling apparatus, with which even drilling operations requiring a particularly great amount of power can be carried out with a construction that is as simple and cost-effective as possible. Furthermore, it is an object of the invention to provide an efficient method for introducing a drilling element into the soil.

The drilling apparatus according to the invention is characterized in that the turning device is fixed to the mast and can be engaged with the drilling element driven by the rotary drive in order to support the torque.

A basic idea of the invention resides in the fact that a turning device is provided directly on the mast, with the turning device being directly engageable with the drilling element, whereby at least at specific points of time an additional torque can be applied to the drilling element besides the normal rotary drive. The drilling element can either be a drilling tool, which is extracted again from the drill hole after the introduction, or a screw pile or anchor element which directly serves as a foundation element and remains in the soil. If the torque of the rotary drive does not suffice to introduce the drilling element, a torque support can be effected by means of the turning device. By using a collet with an operating cylinder to turn the collet it is possible to generate a very high torque for a limited turning angle. As experience has shown that during drilling the maximum drilling torque is not present during the entire drilling time but only as a peak load at very limited points of time, the drive of the drilling apparatus can be laid out in a cost-effective manner for the normal drilling torque. To bridge the torque peak the torque support can be employed.

According to the invention it is preferred that the turning device is fixed to the lower end portion of the mast. This permits a torque support even when the drilling element is almost completely inserted into the soil.

An efficient drilling operation is achieved in accordance with the invention in that the turning device is supported on the mast by a supporting bearing, through which the collet can be pivoted and/or turned. As a result, the torque support can act on the drilling element even during a feed motion of said drilling element.

A particularly tension-free arrangement is achieved according to the invention in that the at least one operating cylinder and/or a supporting arm of the collet is mounted on gimbals through the supporting bearing. As a result, certain deviations of the drilling element can also be compensated flexibly by the supporting bearing so that a very good torque transmission by the turning device is achieved at all times.

Another embodiment of the invention is characterized in that the collet has two clamping jaws which can be adjusted by means of a clamping cylinder between a clamping position and a free-running position. An adjustable collet permits a clamping of the drilling element along the entire length and is also able to compensate for differences in diameter of the drilling element. The clamping jaws can be adapted to fit the respective drilling element so that a good transmission of force is ensured in the clamping position and a distance to the drilling element is maintained in the free-running position. The clamping cylinder and the operating cylinders of the turning device are preferably designed as hydraulic cylinders which are able to generate particularly high forces.

In principle, the feeding of the drilling element can be applied by the rotary drive alone through corresponding screw threads located on the drilling element. The feeding can take place for example through a rope winch or a toothed rack. In addition, the mast can be designed as a leader, with an upper part of the mast being movable with respect to a basic mast.

Finally, it is intended according to the invention that a control device is provided, through which the rotary drive, the feed drive and the turning device can be operated in a coordinated manner. The control device can thereby coordinate the continuous rotary drive with the discontinuous turning device. Thus, during the periods of the torque support by the turning device the rotary drive can also be operated in a discontinuous manner.

For a high flexibility of the drilling apparatus it is intended according to the invention that the mast is pivotally supported on a carriage. In this way the mast can be pivoted together with the turning device between an approximately vertical operating position and an approximately horizontal transport position.

The method in accordance with the invention is characterized in that a turning device having a collet is engaged with the drilling element and in that a supportive torque is applied to the drilling element through the turning device by means of at least one operating cylinder. This way the turning device can balance out the torque peaks so that the continuous rotary drive can be laid out in a cost-effective manner for the normal torque load.

For an efficient drilling progress it is intended according to the invention that the turning device is pivoted and/or moved at least gradually with the drilling element in the drilling direction. To this end the turning device is movably arranged through a corresponding pivot or slide bearing on the mast between an upper and a lower position. By preference, a resetting device is provided through which the turning device is reset from the lower position to the upper position again. In the upper position the turning device can then be moved to the lower position again in response to the feeding through a corresponding clamping with the drilling element.

To coordinate or synchronize the discontinuous and continuous drives, it is intended according to the invention that the rotation of the rotary drive, the feed motion of the drilling element and the operation of the turning device are controlled in a coordinated manner.

Furthermore, it is intended in accordance with the invention that the torque support is effected at specific periods of time only, in particular during a final drilling phase. When a drilling element is drilled into the soil the torque load increases with an increasing drilling depth due to the higher friction surfaces. Therefore the torque support is preferably effected in the final phase so that a reliable turning motion is ensured at this point of time, too.

Generally, the drilling element can be constituted by a drilling tool that can be removed from the drill hole again, such as a drilling screw, a drilling bucket or any other chosen drilling tool that operates in a continuous or discontinuous fashion. However, it is preferred according to the invention that a screw pile, in particular having a tapered screw tip, is used as drilling element. Especially during the drilling-in of such foundation piles with screw flights high torques usually have to be applied, since a considerable part of the soil is being displaced whereby a high surface friction is generated.

Another embodiment of the invention resides in the fact that in order to take foundation measures the screw pile is driven through loose soil layers up to a solid soil layer, with the torque support being effected for the introduction into the solid soil layer. Thus, with the rotary drive screw piles can be screwed through the loose soil and anchored efficiently in the solid soil layers with the support of the casing device.

DESCRIPTION OF THE SEVERAL VIEWS OF THE DRAWINGS

In the following the invention will be described by way of a preferred embodiment which is schematically shown in the accompanying drawings. In the drawings.

DETAILED DESCRIPTION OF THE INVENTION

Figure 1:
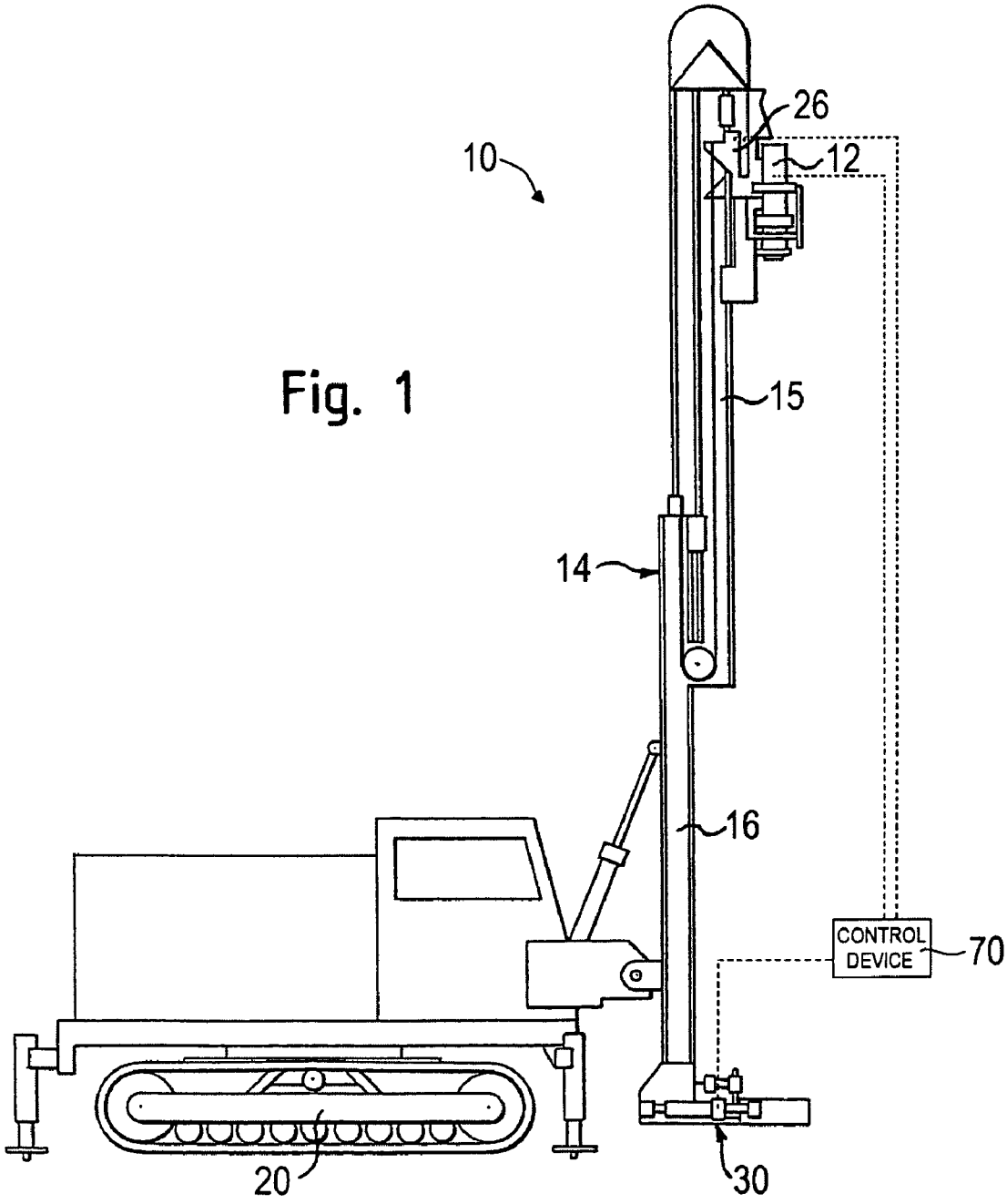
FIG. 1 shows a side view of a drilling apparatus according to the invention.

The drilling apparatus 10 according to the invention shown in FIG. 1 has a carriage 20 designed as a crawler, to which a mast 14 is pivotally hinged between a horizontal transport position and a depicted vertical operating position. The mast 14, which can be pivoted in a known manner by hydraulic cylinders, is constructed as a so-called leader with a stationary basic mast 16 on which a movable mast 15 is slidably supported through a moving device.

On the movable mast 15 a rotary drive 12 is slidably supported through a feed drive 26, which rotary drive serves to drive a drilling element not depicted here. To the lower end of the mast 14 a turning device 30 is fixed as a torque support which shall be explained in more detail hereinafter. A control device 70 is provided to operate the rotary drive 12, the feed drive 26, and the turning device 30. The connection of the control device to the rotary drive 12, the feed drive 26 and the turning device 30 is shown by phantom lines.

Figure 3:
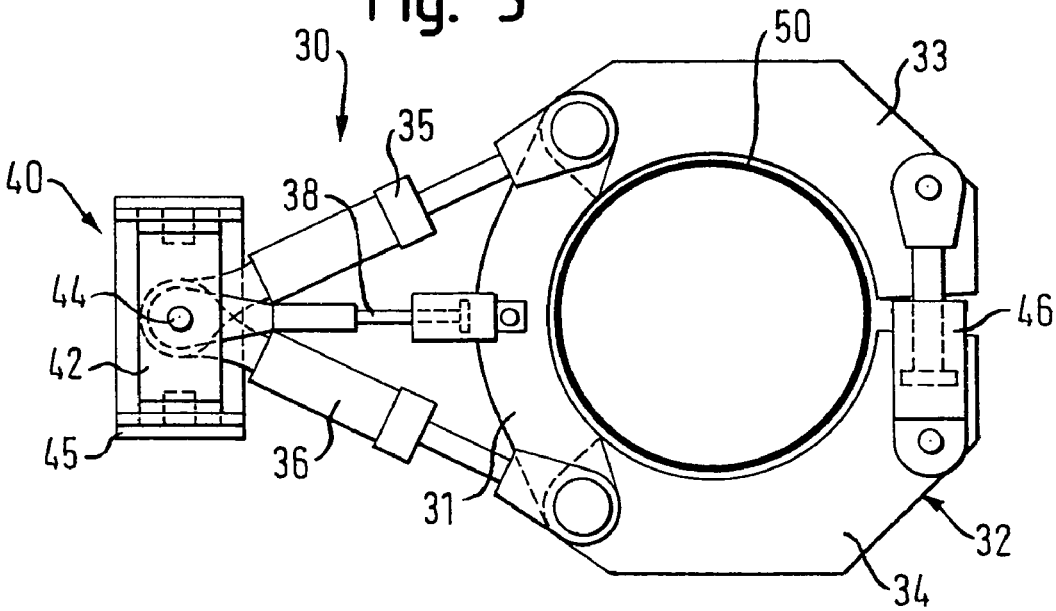
FIG. 3 shows a top view onto the turning device of FIG. 2.

In FIG. 3 the turning device 30 is shown with a collet 32 which encloses a drilling element 50. The collet 32 illustrated in FIG. 3 is in the free-running position in which the collet is spaced on all sides from the enclosed drilling element 50 so that the drilling element 50 can be moved freely by the collet 32 in the drilling direction that extends perpendicularly to the plane of the drawing.

The collet 32 comprises an arched collet base 31, at both ends of which a clamping jaw 33, 34 is each pivotally hinged. The free ends of both clamping jaws 33, 34 are arranged opposite each other and connected by means of a clamping cylinder 46. By retracting the clamping cylinder 46 the clamping jaws 33, 34 can be moved towards each other, whereby a force-locking connection can be established with the drilling element 50.

The collet base 31 is fixed to the mast 14 via a length-adjustable supporting arm 38 by means of a supporting bearing 40. For a Cardanic suspension the supporting bearing 40 has a horizontal swivel bolt 42 that is rotatably supported in a bearing block 45. On the horizontal swivel bolt 42 a vertically directed vertical swivel bolt 44 is provided, on which the mast-facing end of the supporting arm 38 and the mast-facing ends of two operating cylinders 35, 36 are pivotally supported. The operating cylinders 35, 36 serve to turn the collet 32 with respect to the supporting bearing 40, with the collet-facing ends of the operating cylinders 35, 36 being each pivotally supported on the collet base 31 in those points in which the clamping jaws 33, 34 are also supported on the collet base 31.

Figure 2:
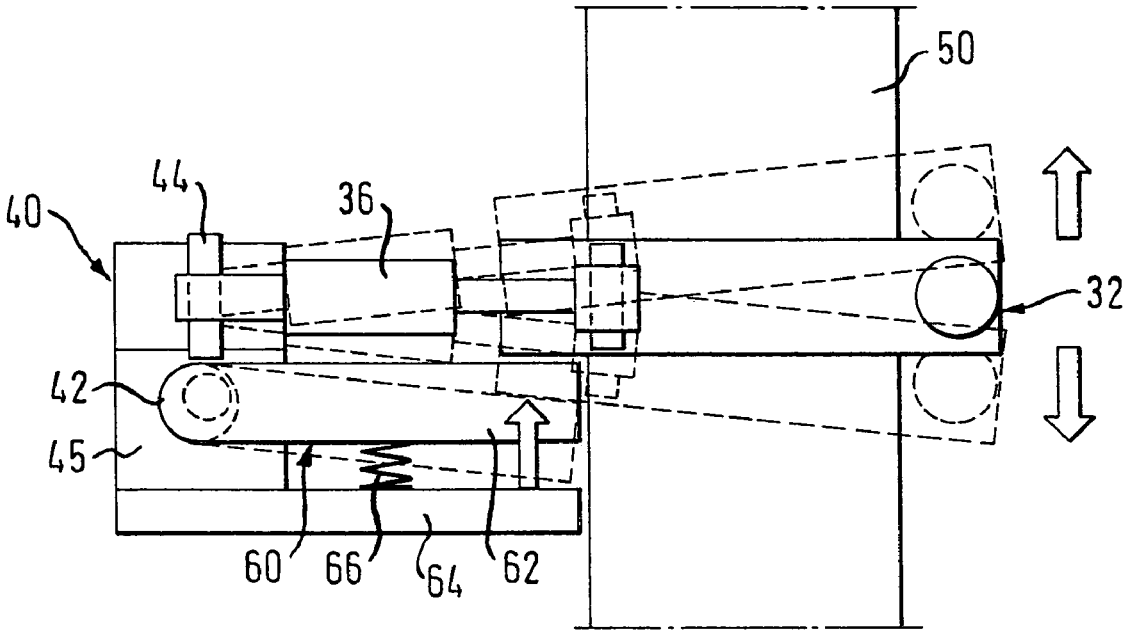
FIG. 2 shows a schematic side view of the turning device.

The supporting bearing 40 renders it possible that the collet 32 can follow the clamped drilling element 50 when this is moved in the drilling direction, as is schematically shown in FIG. 2. When a feed motion of the drilling element 50 takes place during a drilling operation, the collet 32, being in the clamping position, follows with its operating cylinders 35, 36 the motion of the drilling element 50 towards the ground. After the clamping cylinder 46 has been opened, the collet 32 has to be reset upwards for a renewed turning operation, which is possible by means of a resetting device 60.

The depicted resetting device 60 includes a pressure plate 62 supported on the horizontal swivel bolt 42, which plate can be reset by means of a compression spring 66 that rests on an abutment 64.

Figure 4A:
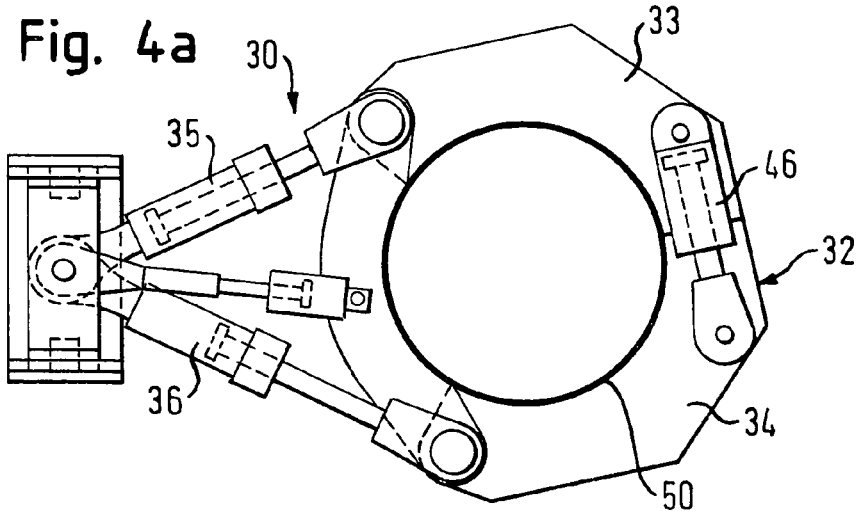
FIG. 4 shows top views onto the turning device in various turning positions.
Figure 4B:
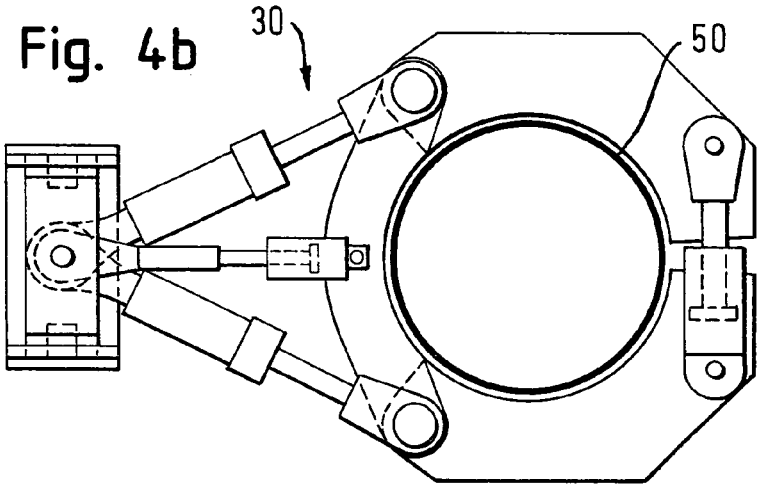
Figure 4C:
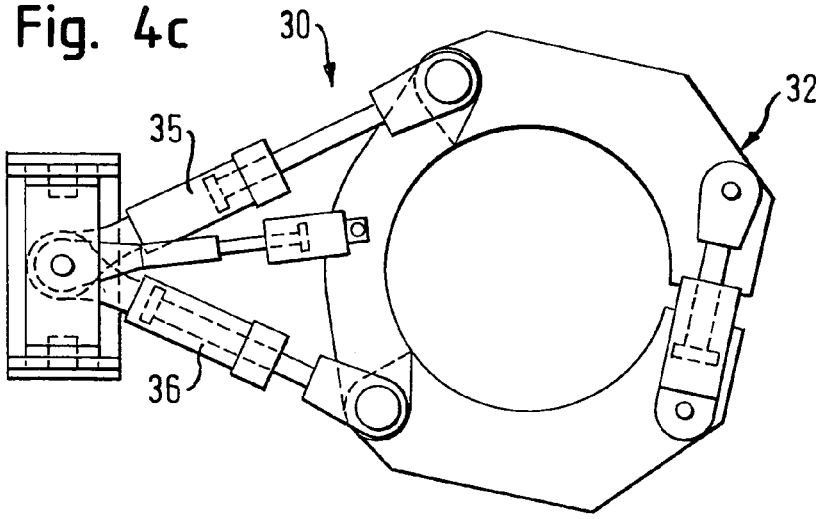

The operation of the torque support of the turning device 30 is schematically shown in FIGS. 4*a* to 4*c*. FIG. 4*b* shows the free-running position which has already been described in conjunction with FIG. 3.

According to FIG. 4*a* the clamping cylinder 46 is retracted, with the clamping jaws 33, 34 enclosing the drilling element 50 in a force-locking manner. By retracting the first operating cylinder 35 and extending the second operating cylinder 36 an anticlockwise turning of the collet 32 and thus of the clamped drilling element 50 can be effected. This turning can be used to support the torque.

According to FIG. 4*c* a clockwise turning of the collet can be achieved on the other hand by extending the first operating cylinder 35 and retracting the second operating cylinder 36.

The invention claimed is:

1. Drilling apparatus for introducing a drilling element into the soil, the drilling apparatus comprising:

a mast;

a rotary drive, which is supported on the mast for introducing the drilling element arranged rotatably and slidably on the mast;

at least one operating cylinder; and a turning device having a collet that can be turned by means of the at least one operating cylinder;

a supporting bearing;

wherein the turning device is supported on the mast by the supporting bearing through which the collet can be pivoted in the drilling direction and can be engaged with the drilling element driven by the rotary drive in order to support the torque.

2. Drilling apparatus according to claim 1, wherein the turning device is fixed to a lower end portion of the mast.

3. Drilling apparatus according to claim 1, wherein the collet has a supporting arm and the at least one operating cylinder and/or the supporting arm is gimbal-mounted through the supporting bearing.

4. Drilling apparatus according to claim 1, wherein a feed drive is provided to move the drilling element along the mast.

5. Drilling apparatus according to claim 4, wherein a control device is provided, through which the rotary drive, the feed drive and the turning device can be operated in a coordinated manner.

6. Drilling apparatus according to claim 1, wherein the mast is pivotally supported on a carriage.

7. A method for introducing a drilling element into the soil using a drilling apparatus having a rotary drive, which is supported on a mast for introducing the drilling element arranged rotatably and slidably on the mast; at least one operating cylinder, a turning device having a collet that can be turned by means of the at least one operating cylinder, and a supporting bearing, wherein the turning device is supported on the mast by the supporting bearing through which the collet can be pivoted in the drilling direction and can be engaged with the drilling element driven by the rotary drive in order to support the torque the method comprising the steps of:

setting the drilling element into rotation by means of the rotary drive and moving the drilling element along the mast;

engaging the turning device with the drilling element; and applying a supportive torque to the drilling element through the turning device by means of the at least one operating cylinder.

8. Method according to claim 7, wherein the turning device is pivoted and/or moved at least gradually with the drilling element in the drilling direction.

9. Method according to claim 7, wherein the rotation of the rotary drive, the feed motion of the drilling element and the operation of the turning device are controlled in a coordinated manner.

10. Method according to claim 7, wherein the torque support is effected at specific periods of time only, in particular during a final drilling phase.

11. Method according to claim 7, wherein a screw pile is used as the drilling element.

12. Method according to claim 11, wherein the screw pile has a tapered screw tip.

13. Method according to claim 11, wherein in order to take foundation measures the screw pile is driven through loose soil layers up to a solid soil layer, with the torque support being effected for the introduction into the solid soil layer.

14. Drilling apparatus for introducing a drilling element into the soil, the drilling apparatus comprising:

a mast;

a rotary drive, which is supported on the mast for introducing the drilling element arranged rotatably and slidably on the mast;

at least one operating cylinder; and a turning device having a collet that can be turned by means of the at least one operating cylinder;

a supporting bearing;

wherein the collet has two clamping jaws which can be adjusted by means of a clamping cylinder between a clamping position and a free-running position and the turning device can be engaged with the drilling element driven by the rotary drive in order to support the torque.

* * * * *